US011499699B2

(12) United States Patent
Gladden et al.

(10) Patent No.: US 11,499,699 B2
(45) Date of Patent: Nov. 15, 2022

(54) PLANAR MECHANICAL ACTUATION SYSTEM FOR ADJUSTABLE LUMINAIRES

(71) Applicant: Glint Photonics, Inc., Burlingame, CA (US)

(72) Inventors: Christopher Gladden, San Mateo, CA (US); Victor Chub, Hayward, CA (US); Peter Kozodoy, Palo Alto, CA (US)

(73) Assignee: GLINT PHOTONICS, INC., Burlingame, CA (US)

( * ) Notice: Subject to any disclaimer, the term of this patent is extended or adjusted under 35 U.S.C. 154(b) by 0 days.

(21) Appl. No.: 17/689,060

(22) Filed: Mar. 8, 2022

(65) Prior Publication Data

US 2022/0290845 A1 Sep. 15, 2022

Related U.S. Application Data

(60) Provisional application No. 63/158,677, filed on Mar. 9, 2021.

(51) Int. Cl.

| | |
|---|---|
| ***F21V 14/06*** | (2006.01) |
| ***F21V 17/02*** | (2006.01) |
| ***F21V 5/00*** | (2018.01) |

(52) U.S. Cl.

CPC ..... *F21V 14/06* (2013.01); *F21V 5/007* (2013.01); *F21V 17/02* (2013.01)

(58) Field of Classification Search

CPC ..... F21V 14/06; F21V 5/007; F21V 17/02; F21V 14/04–085

See application file for complete search history.

(56) References Cited

U.S. PATENT DOCUMENTS

| | | | | |
|---|---|---|---|---|
| 11,371,677 | B2 * | 6/2022 | Bory | F21V 14/06 |
| 2015/0300604 | A1 * | 10/2015 | Urik | F21V 11/186 362/281 |
| 2018/0245776 | A1 * | 8/2018 | Gladden | F21V 7/04 |
| 2022/0057072 | A1 * | 2/2022 | Smets | F21V 14/02 |

* cited by examiner

*Primary Examiner* — Rajarshi Chakraborty
*Assistant Examiner* — Michael Chiang
(74) *Attorney, Agent, or Firm* — VLP Law Group, LLP; David J. Thibodeau, Jr.

(57) ABSTRACT

A mechanical actuation system for a light fixture that allows for translation of an array of optics relative to an array of light sources in a defined plane. The system can prevent undesired movement such as rotation or out-of-plane motion. A simple and intuitive user interface enables a user to point a resulting light beam in a desired direction without requiring an understanding of the internal mechanical system. The user interface may include a manually manipulated touch point such as a joystick, knob, or other interface.

14 Claims, 6 Drawing Sheets

PLANAR MECHANICAL ACTUATION SYSTEM FOR ADJUSTABLE LUMINAIRES

GOVERNMENT LICENSE RIGHTS

This invention was made with Government support under contract DE-AR0000644 awarded by the Advanced Research Projects Agency-Energy (ARPA-E), a division of the Department of Energy. The Government has certain rights in the invention.

TECHNICAL FIELD

The present invention relates to mechanics, specifically to mechanical systems for optical alignment which control motion in a plane.

BACKGROUND

Directional lighting is important in many contexts; for example, in providing illumination for task areas in a workplace, for highlighting objects in a retail space or an artistic exhibition, for illuminating walkways and roadways outdoors, and many more applications. In most applications it is desirable to have light beams that can be pivoted over a range of directions.

In traditional luminaires (light fixtures), the entire fixture is pointed to steer the beam, and thus the actuation system consists of several rotational mounts, such as a gimble. These gimbaled fixtures allow for adjustment of individual lights, which are often part of a larger group of lights or in a configurable system such as a track lighting system. These gimbal systems that pivot each entire fixture results in a disorganized appearance, as different fixtures are pointed in different directions. Further, pivoting the fixture increases the operating volume required for each fixture, limiting where fixtures can be placed. An advanced luminaire could feature a static housing that can emit a steerable beam via in-plane translation of an array of focusing optical elements relative to a corresponding array of light sources, wherein each focusing optical element of the array of focusing optical elements is associated with at least one of the light sources in the array of light sources. Such luminaires are described in U.S. Pat. Nos. 10,809,444B2, 10,837,624B2, 10,393,348B2, and 11,131,441B2.

SUMMARY

Such luminaires would benefit from a mechanical system that provides translation of internal optics. This mechanical system should allow simple and intuitive motion of the internal optics from outside the luminaire and prevent any undesired motions that might degrade the beam. For example, it may be desired to prevent rotation of the array of optical elements in relation to the array of light sources, as such rotation would cause the beam from each light source to be aimed differently. A simple mechanical system that allows the arrays to be translated relative to each other while preventing such rotation is thus needed.

The embodiments discussed herein include a mechanical actuation system that allows for the translation of an array of optics relative to an array of light sources. The translation system allows movement in a defined plane and has the ability to prevent rotation in applications where it is undesired. The actuation system also prevents motion out-of-plane to prevent the creation of undesirable optical effects. The system has a simple and intuitive user interface that can be accessed either on the front or back of the luminaire. The actuation system allows a user to point the light beam in the desired direction without requiring an understanding of the internal mechanical system. The system is actuated by the user manually manipulating a touch point on the luminaire. This touch point could be a joystick, puck, or other interface.

DESCRIPTION OF THE SPECIFIC EMBODIMENTS

1. Mechanical System

Figure 1A:
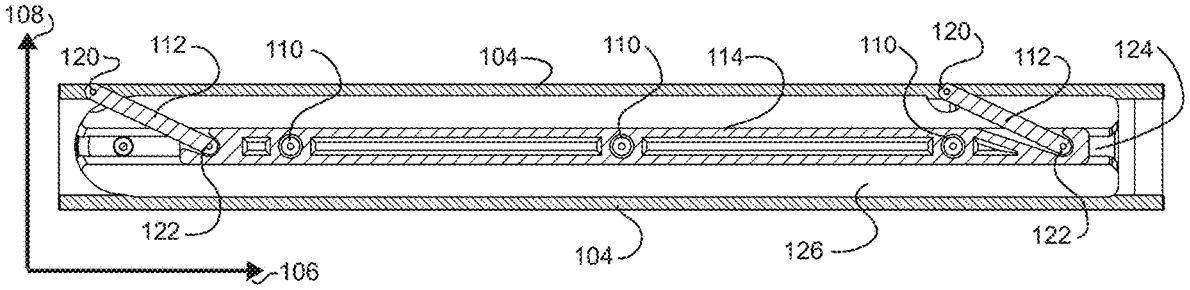
FIGS. 1A to 1D—Schematic drawings of a mechanical actuation system with two links to prevent rotation.
Figure 1B:
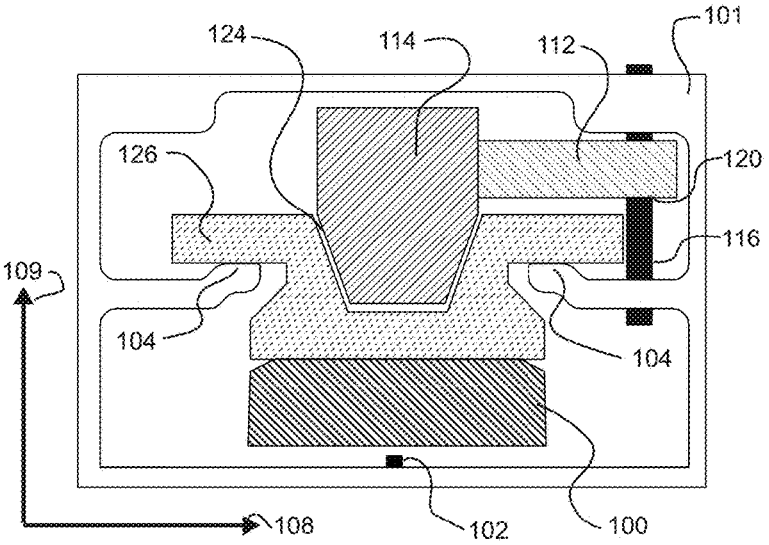
Figure 1C:
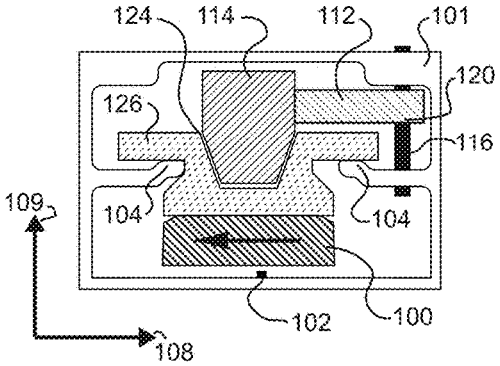
Figure 1D:
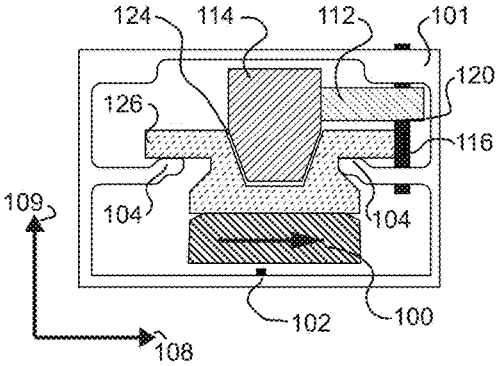

FIG. 1A shows a top-down view of a luminaire 101 with a linear design, and FIGS. 1B, 1C, and 1D provide various views of the same system in cross-section. In particular, FIG. 1B shows the system from an end view, and FIG. 1C and FIG. 1D show the system translated in a transverse axis 108 from an end view.

To prevent rotation of an optics array 100 relative to a light source array 102 there is a linkage system consisting of two equal length links 112 and one rail 114. The links 112 are each attached to a fixed point 120 and then attached to a rail attachment point 122, with one link as close to each end as possible. These attachments hold the links in place but allow rotation and may use various mechanisms, including pins (as shown in the example by element 116), fasteners, or snap-fit features. A separation between the two fixed points 120 to which the links 112 are attached is the same as a separation between the two points that the links 112 are attached to the rail 114. A line drawn between the two fixed attachment points 120 will therefore be equal length and parallel to a line drawn between the two rail attachment points 122, and together with the links these two lines describe a parallelogram and form a four-bar linkage mechanism The links 112 are sized such that they allow the rail 114 to move in an arc that translates across the entire desired range of motion in the transverse axis 108. To achieve this, the link 112 should be at least as long as the desired translation distance. The nature of the rigid links allows the rail 114 to move in an arc without allowing it to rotate.

The rail has a sliding interface 124 with an optics holder 126. The optics holder 126 and rail 114 are designed with a sliding interface that only allows motion in one direction, parallel to the longitudinal axis 106, and therefore prevents rotation. By allowing the optics holder 126 to slide in the longitudinal axis 106 along the rail 114, and to also slide in the transverse axis 108 through motion of the links 112, the system allows for free motion in both axes while preventing both rotation and out-of-plane motion.

The optics array 100 may itself be fixed to the optics holder 126, so by constraining the motion of the optics holder 126, the motion of the optics array 100 is also constrained. In an alternative construction, the optics holder may be omitted from the system and the array of optics designed to slide directly within the rail itself.

In the example shown in FIGS. 1B, 1C, and 1D, the rail 114 has a tapered end that forms the sliding interface 124 in a matching groove in the optics holder 126, however many different designs are possible to achieve the same purpose of constrained linear motion.

Figure 2A:
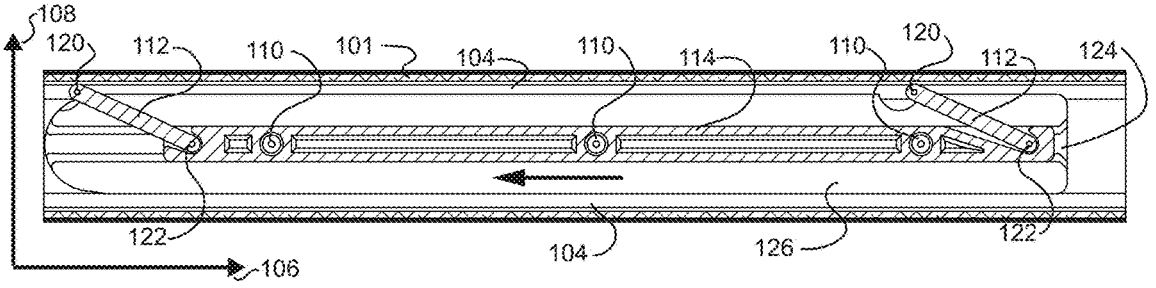
FIGS. 2A to 2D—Schematic drawings of a mechanical system actuated to four different positions.
Figure 2B:
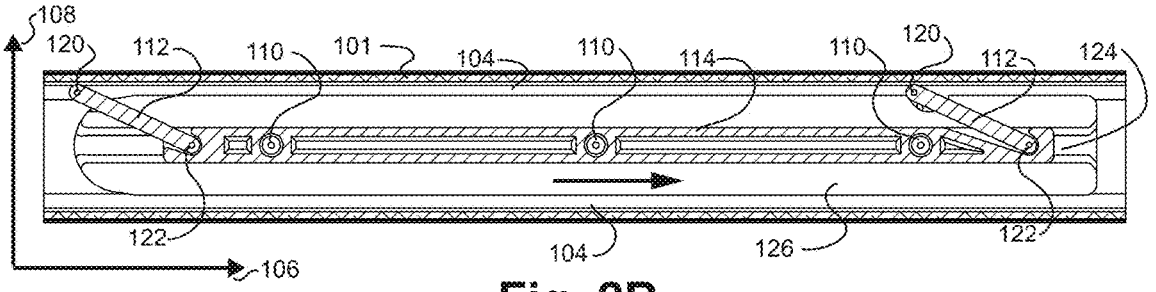
Figure 2C:
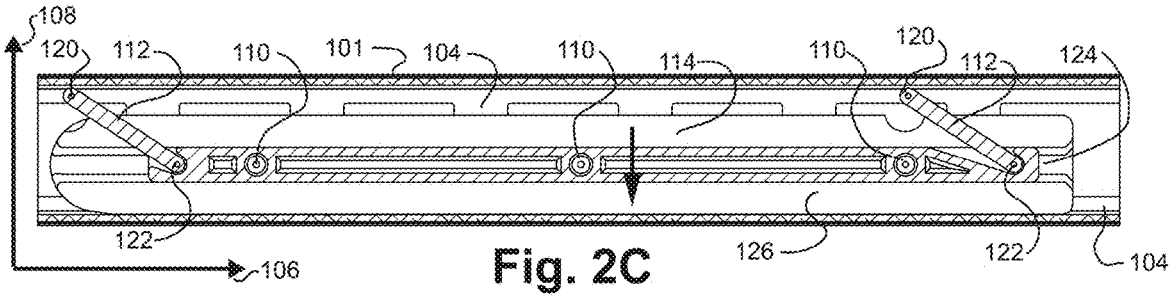
Figure 2D:
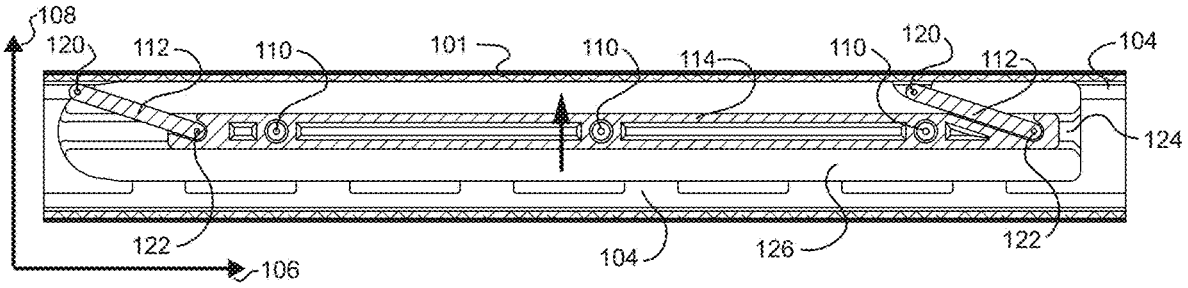

FIG. 2A and FIG. 2B show the system actuated to the limits in the longitudinal axis 106 from a top view. FIG. 2C and FIG. 2D show the system actuated to the limits in the transverse axis 108 from a top view.

In addition to preventing relative rotation of the optics array 100 and the light source array 102, it is also desired to prevent out-of-plane motion that would result in changing values of the separation distance between the two arrays. Many approaches are possible to constrain such motion. In the example shown in these figures, translation is restricted to a plane using sliding interface 104 between the housing of the luminaire 101 and the optics holder 126. This sliding interface 104 consists of one or more fixed planes that prevent motion perpendicular to the two axes of motion. To maintain close contact with the sliding interface 104, one or more springs 110 may be used to provide a normal force by pushing against a fixed plane (in this case the inner surface of the housing of the luminaire 101) to push the optics holder 126 against the sliding interface 104. The spring 110 maintains a sliding contact point 112 with the fixed plane, so it provides a uniform normal force regardless of the position of the optics array 100 relative to the light source array 102. In the example shown in FIGS. 2A-2D, the spring 110 is shown fixed in place on the rail 114 and maintaining sliding contact with the housing of the luminaire, but the opposite configuration may also be used. The system may also be designed so that rather than the optics holder 126 being in contact with the sliding interface 104 it is the rail 114 or optics array 100 that is in contact with the sliding interface 104.

Alternatively, other approaches may be used to constrain out-of-plane motion. For example, instead of using springs 110, a normal force to keep the sliding interface 104 in close contact may be provided by magnetic force between a ferrous material and a permanent magnet. Another alternative is to design and fabricate the luminaire components to fit tightly together so that the moving components are physically constrained to prevent excessive out-of-plane motion even without a mechanism to provide normal force against the sliding interface 104.

2. User Interface

Figure 3A:
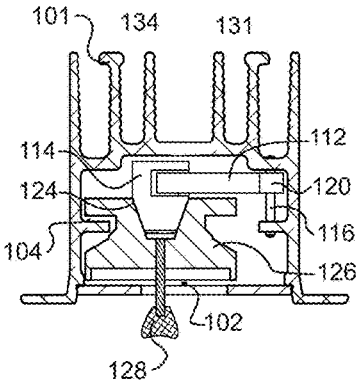
FIGS. 3A to 3D—Schematic drawings of a mechanical system with direct actuation.
Figure 3B:
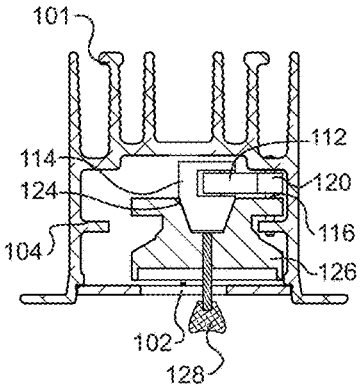
Figure 3C:
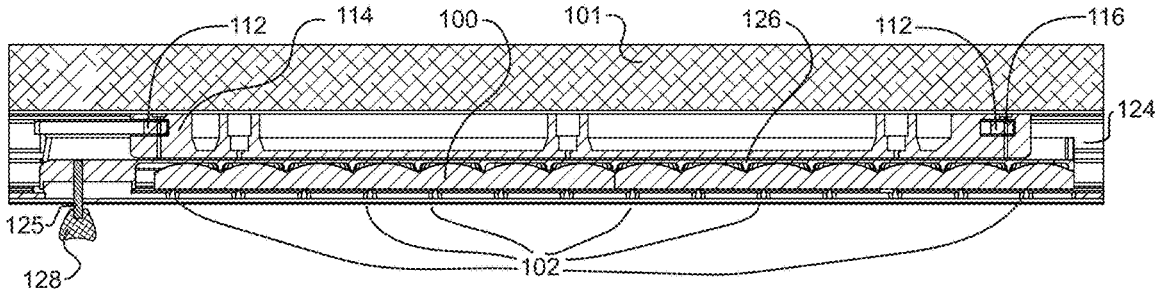
Figure 3D:
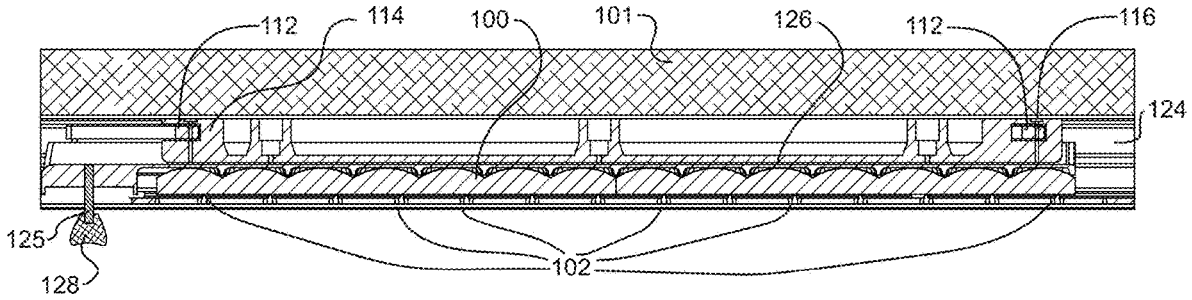

In order to control the aiming of the light beam from the luminaire, a user interface on the luminaire 101 may comprise an actuation touch point 128. The actuation touch point 128 may be directly attached to the optics holder 126 or the optics 100 and be accessible from the front of the luminaire 101. The user can manipulate the optics array 100 by moving the actuation interface in the same direction as the desired motion of the optics. FIG. 3A and FIG. 3B show such a "direct" actuation system translated to its limits in the transverse axis 108, from an end view. FIG. 3C and FIG. 3D show the direct actuation system translated to its limits in the longitudinal axis 106, from a side view. In these examples, the actuation touch point 128 is attached to the optics holder 126 via a fixed shaft 125, although many different constructions are possible. Further, the actuation touch point 128 may be designed to be accessed from the back or sides of the luminaire 101, rather than the front.

Figure 4A:
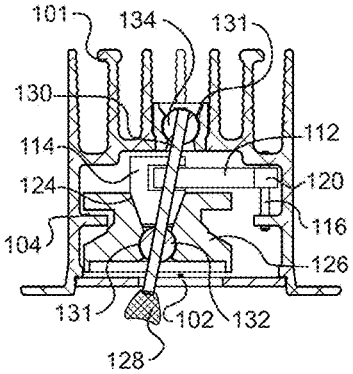
FIGS. 4A to 4D—Schematic drawings of a mechanical system with joystick actuation.
Figure 4B:
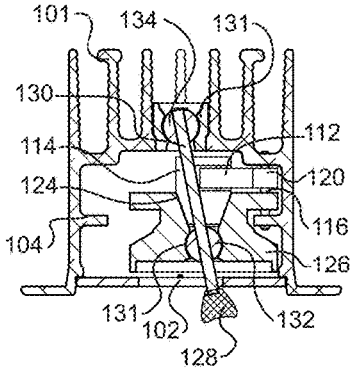
Figure 4C:
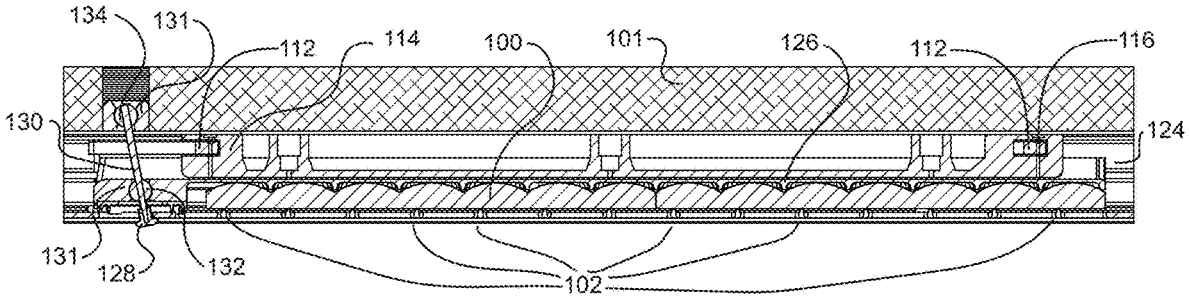
Figure 4D:
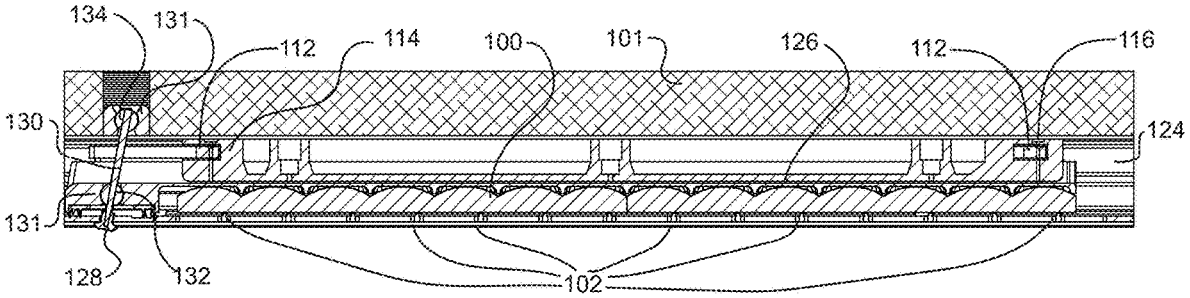

An alternative user interface, shown in the example design of FIG. 4A to 4D, comprises a joystick 130 that is used to manipulate the optics array 100 within the luminaire 101. FIG. 4A and FIG. 4B show the joystick actuation system translated to its limits in the transverse axis 108, from an end view. FIG. 4C and FIG. 4D show the joystick actuation system translated to its limits in the longitudinal axis 106, from a side view. The joystick translates angular motion into planar translation using two ball and socket joints 131, a moving ball 132 and a fixed ball 134. The fixed ball 134 does not move relative to the luminaire housing 101, while the moving ball 132 is captured in a ball and socket joint 131 formed with or attached to the optics holder 126 (or alternatively directly to the optics array 100), and therefore moves with the optics array 100. In the example of FIG. 4A to 4D, the fixed ball 134 is attached to the back side (the "non-light emitting" side) of the luminaire 101 in a ball and socket joint 131 and the joystick 130 extends from the fixed ball through the moving ball 132 to an actuation touch point 128 extending out the front side of the luminaire. Other configurations are also possible. For example, the fixed ball 134 may be located instead in a socket on the front face (the "light-emitting side") of the luminaire, so that the joystick 130 extends from the moving ball 132 (which is connected to the optics holder 126) through the fixed ball 134 and extends out to an actuation touch point 128 extending out the front side of the luminaire. Alternatively, the joystick 130 may be designed to extend out the backside of the luminaire 101 using similar principles and designs.

In all cases, the relationship between angular motion of the joystick 130 and translation of the optics array 100 may be controlled through the choice of the separation between the two balls along the vertical axis 109.

Further, it may be preferable to design the system so that at least one of the balls has a central hole which allows the joystick 130 to slide easily within it in order to accommodate the changing distance between the two balls as the joystick 130 is actuated. The other ball may preferably be permanently attached onto the joystick 130, either by forming it as part of the joystick 130 or by forming it as a separate part that is threaded onto or otherwise attached to the joystick 130. In the example of FIG. 4A to 4D, the fixed ball 134 is permanently attached to the joystick 130 and the moving ball 132 is able to slide along the shaft of the joystick 130.

The user interface examples provided above describe manual adjustment of beam direction via a touch point. However these designs may also be adapted for mechanized adjustment by attaching a motorized actuator to the touch point or directly to the optics holder 126 or another element of the mechanical system, and providing a control system to adjust the motorized actuator.

3. Secondary Optics

Figure 5A:
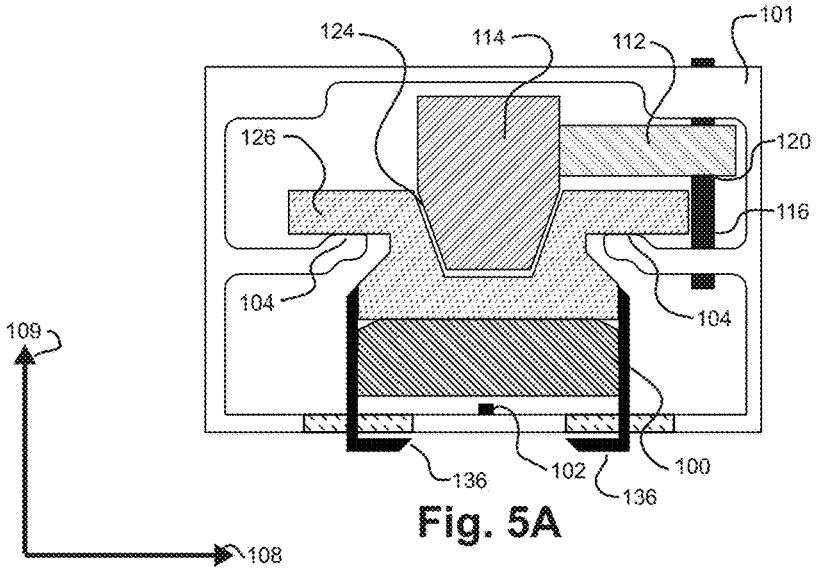
FIGS. 5A to 5C—Schematic drawings of a glare mask attachment with optional refractive lens and diffuser film.
Figure 6:
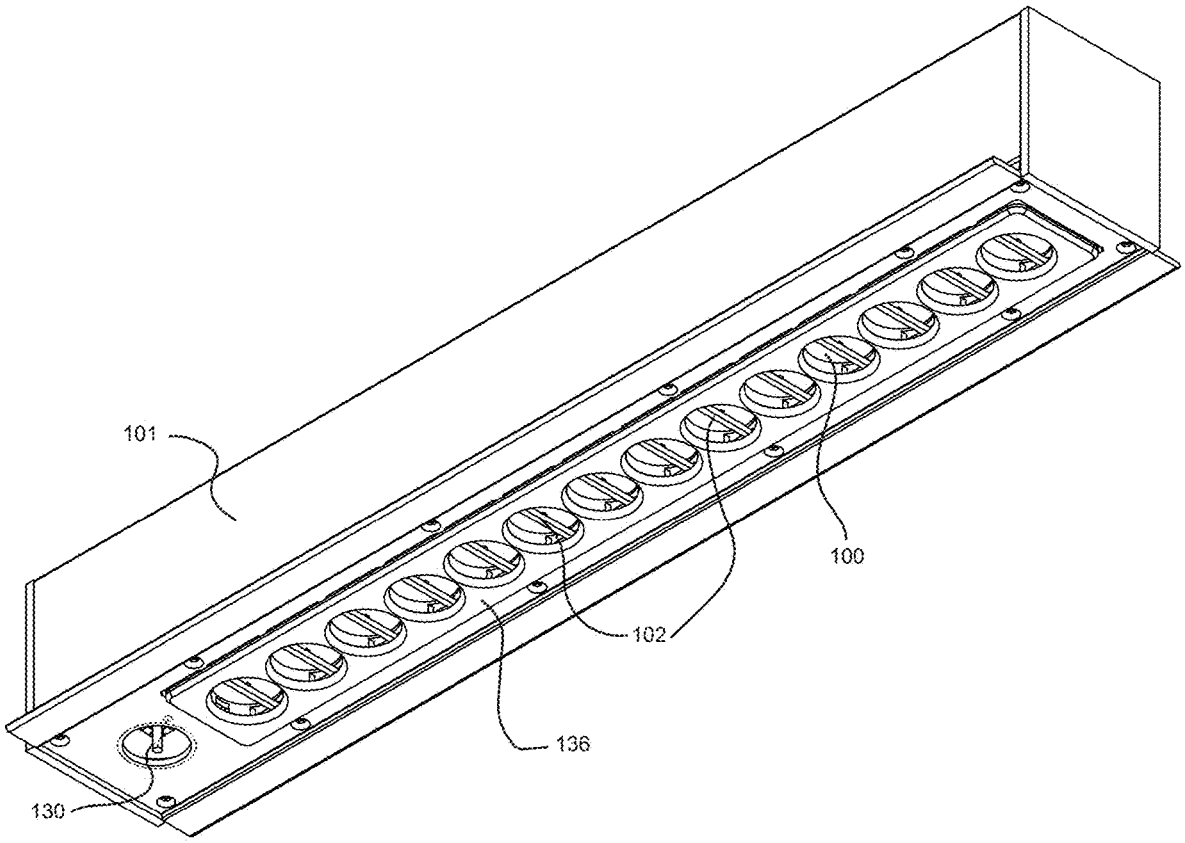
FIG. 6—Isometric view of a luminaire with a glare mask.

Additional optical elements may be placed near the front face of the luminaire to condition the output beam. FIG. 5A shows a moving glare baffle 136 consisting of an array of apertures corresponding to the array of optics 100, where the apertures are designed to prevent high angle light from escaping the luminaire. FIG. 5A shows a system where a moving glare baffle 136 is directly attached to the optics holder 126 so that it moves with the optics array 100 as the beam direction is adjusted. Alternatively, the moving glare baffle 136 may be attached directly to the optics array 100. Alternatively, the moving glare baffle 136 may be attached to the joystick 130 so that it translates with a known ratio relative to the optics array 100. FIG. 6 shows an isometric view of a joystick actuated system with a moving glare baffle 136 that is directly attached to the optics 100.

Figure 5B:
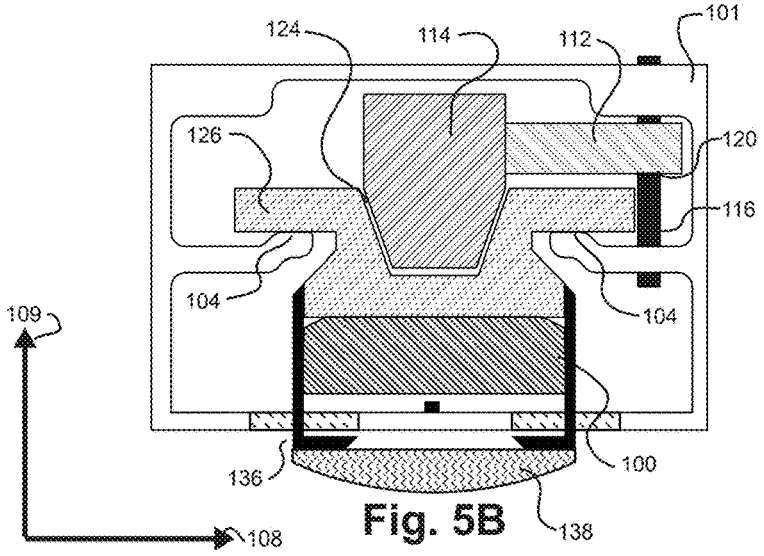
Figure 5C:
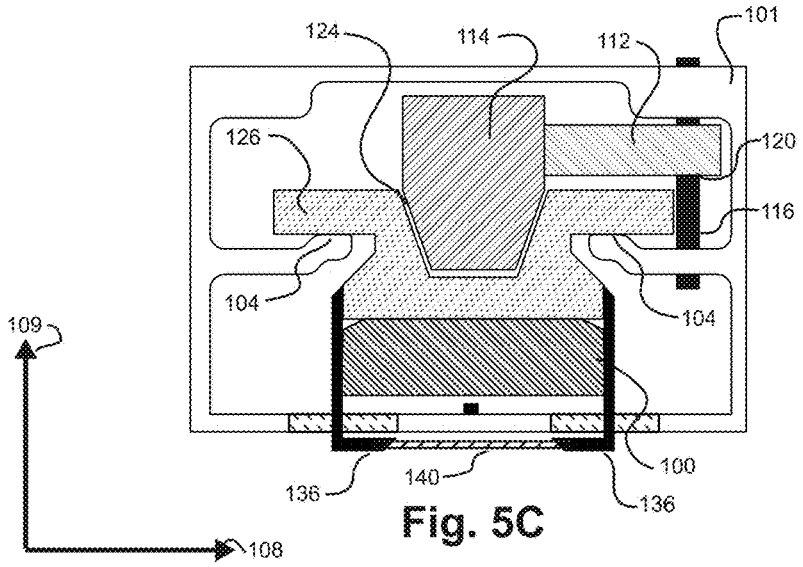

Other secondary optics are possible. Examples are shown in FIGS. 5B and 5C, in which a refractive lens or lens array 138 or a diffuser film 140 (respectively) are provided on the glare baffle 136 to provide additional control over the output of the luminaire. Such elements may be employed in tandem with a glare baffle 136 as shown in FIGS. 5B and 5C or without a glare baffle, and may be made moving by attachment to a moving element or fixed by attachment to the housing of the luminaire 101.

The glare baffle 136 and/or other secondary optical elements may also be used themselves as the actuation touch point 128 for adjusting the beam direction from the luminaire 101, or may be provided with a knob or other user affordance to serve this purpose.

In the example designs provided in the figures herein, the luminaire 101 uses a linear light source array 102 and a matching linear optics array 100 consisting of dielectric-filled reflective lenses that focus the light from the sources in a back-firing configuration. However, a wide variety of array geometries and focusing optics may be combined with the mechanical design approaches, user interfaces, and secondary optics approaches described here. The arrays may be of any shape and contain any number of elements, even just a single light source 102 with matching focusing optic 100. The focusing optics may be of any type, including hollow reflectors, refractive lenses, and other types. Further, while the examples use light sources 102 that are comprised of LEDs mounted on a circuit board with apertures that permit light transit, many other mechanisms of providing the arrayed light sources 102 are also possible.

The examples provided herein are not exhaustive, and other useful implementations of the mechanical and optical designs for adjustable luminaires will be evident to those skilled in the art.

The invention claimed is:

1. A luminaire that provides adjustable beam pointing comprising:

an array of light sources;

a corresponding array of optics, wherein each optical element of the array of optics is associated with at least one of the light sources of the array of light sources;

an actuation system to provide in-plane translation of the array of optics relative to the array of light sources while constraining in-plane rotation of the array of optics relative to the array of light sources;

wherein the actuation system comprises a linkage consisting of two links and a rail, wherein the two links are of equal length and wherein each link is attached to the rail and to a corresponding fixed point of attachment via a rotating joint;

wherein a distance between the fixed points of attachment is equal to a distance between the points of attachment of the links to the rail;

and wherein an optics holder, or the array of optics itself, is configured to slide in one axis relative to the rail.

2. The luminaire of claim 1 wherein the actuation system further constrains out-of-plane motion of the array of optics relative to the array of light sources.

3. The luminaire of claim 2 wherein the actuation system further comprises:

a fixed sliding interface; and a mechanism for providing a force to push the rail or the optics holder against the fixed sliding interface.

4. The luminaire of claim 3 in which the force is provided by springs.

5. The luminaire of claim 3 in which the force is provided by one or more magnets attracted to a ferrous material.

6. The luminaire of claim 1 further comprising:

a user interface comprising a touch point arranged to adjust an in-plane position of the array of optics relative to the array of light-sources.

7. The luminaire of claim 6 in which the touch point is coupled to the optics holder or the array of optics.

8. The luminaire of claim 6 wherein the user interface additionally comprises:

a joystick;

a fixed ball-and-socket joint; and a moving ball-and-socket joint;

wherein the moving ball-and-socket joint is attached to the optics holder or the array of optics, and wherein a tip of the joystick provides the touch point.

9. The luminaire of claim 8 in which the fixed ball-and-socket joint is located on a non-light-emitting side of the luminaire.

10. The luminaire of claim 8 in which the fixed ball-and-socket joint is located on a light-emitting side of the luminaire.

11. The luminaire of claim 6 in which the touch point is accessible from a light-emitting side of the luminaire.

12. The luminaire of claim 6 in which the touch point is accessible from a non-light-emitting side of the luminaire.

13. The luminaire of claim 1 further comprising one or more secondary optics attached to one of the optics holder, the optics array, or a housing for the luminaire.

14. The luminaire of claim 13 in which the secondary optics comprises at least a glare baffle designed to prevent high-angle light from escaping the luminaire.

* * * * *